US011732414B2

(12) United States Patent
Kilbourne et al.

(10) Patent No.: US 11,732,414 B2
(45) Date of Patent: Aug. 22, 2023

(54) SEAL STRIP WEAR AND TEMPERATURE MONITORING SYSTEMS AND ASSEMBLIES THEREFOR

(71) Applicants: Stowe Woodward Licensco LLC, Youngsville, NC (US); Mary Lynn Otto, Princeton, WI (US)

(72) Inventors: Brandon Kilbourne, Appleton, WI (US); James Michael Walker, Waupaca, WI (US); Christopher Mason, Bunker Hill, WI (US)

(73) Assignee: Stowe Woodward Licensco LLC, Youngsville, NC (US)

( * ) Notice: Subject to any disclaimer, the term of this patent is extended or adjusted under 35 U.S.C. 154(b) by 0 days.

(21) Appl. No.: 17/518,710

(22) Filed: Nov. 4, 2021

(65) Prior Publication Data

US 2022/0145538 A1 May 12, 2022

Related U.S. Application Data

(60) Provisional application No. 63/229,679, filed on Aug. 5, 2021, provisional application No. 63/111,849, filed on Nov. 10, 2020.

(51) Int. Cl.

| | |
|---|---|
| ***D21F 3/10*** | (2006.01) |
| ***D21G 9/00*** | (2006.01) |
| ***D21F 3/04*** | (2006.01) |

(52) U.S. Cl.

CPC ..... *D21F 3/10* (2013.01); *D21F 3/04* (2013.01); *D21G 9/0036* (2013.01)

(58) Field of Classification Search

CPC .... D21F 3/10; D21F 3/04; D21F 3/02; D21G 9/0036; G01B 17/04; F16J 15/16

See application file for complete search history.

(56) References Cited

U.S. PATENT DOCUMENTS

| | | | | |
|---|---|---|---|---|
| 6,358,370 | B1 | 3/2002 | Huttunen | |
| 6,436,241 | B1 | 8/2002 | Persson et al. | |
| 10,344,864 | B2 | 7/2019 | Schotge et al. | |
| 10,822,744 | B2 | 11/2020 | Reaves et al. | |
| 2005/0126732 | A1 | 6/2005 | Gleason | |
| 2017/0254019 | A1 * | 9/2017 | Keinberger | D21F 3/0281 |

FOREIGN PATENT DOCUMENTS

| | | | | |
|---|---|---|---|---|
| EP | 3623526 | A1 * | 3/2020 | D21F 3/10 |
| EP | 3623526 | A1 | 3/2020 | |

OTHER PUBLICATIONS

"international Search Report and Written Opinion corresponding to International Application No. PCT/US2021/057509 dated Feb. 16, 2022".

* cited by examiner

*Primary Examiner* — Eric Hug
*Assistant Examiner* — Matthew M Eslami
(74) *Attorney, Agent, or Firm* — Myers Bigel, P.A.

(57) ABSTRACT

An assembly for a papermaking machine includes: a seal strip with an upper surface configured to provide a seal for a suction roll; a seal strip holder, the seal strip residing in the seal strip holder and movable relative thereto; and a wear monitoring system. The wear monitoring system may include a magnet and magnetic field sensors or an ultrasonic transducer to monitor movement of the seal strip relative to the holder, thereby indicating wear.

7 Claims, 12 Drawing Sheets

SEAL STRIP WEAR AND TEMPERATURE MONITORING SYSTEMS AND ASSEMBLIES THEREFOR

RELATED APPLICATIONS

The present application claims priority from and the benefit of U.S. Provisional Patent Application Nos. 63/111,849, filed Nov. 10, 2020, and 63/229,679, filed Aug. 5, 2021, the disclosures of which are hereby incorporated herein by reference in full.

FIELD

The present invention is directed generally to papermaking, and more specifically to suction rolls and equipment within a papermaking machine.

BACKGROUND

Paper manufacturing inherently requires at many points in the production process the removal of water. In general the paper pulp (slurry of water and wood and other fibers) rides on top of a felt (in the form of a wide belt) which acts as a carrier for the wet pulp before the actual sheet of paper is formed. Felts are used to carry the pulp in the wet section of the paper machine until enough moisture has been removed from the pulp to allow the paper sheet to be processed without the added support added by the felt.

Quite commonly on the wet end of a paper machine the first water removal is accomplished using a suction roll in a press section (be it a couch, pickup, or press suction roll) used in conjunction with a standard press roll without holes (or against a Yankee dryer in a tissue machine) that mates in alignment with the suction roll. The felt pulp carrier is pressed between these two rolls.

The main component of a suction roll 10 includes a hollow shell 12 (FIG. 1) made of stainless steel, bronze or other metal that has tens of thousands of holes, drilled in a prescribed pattern radially around the circumference of the roll. These holes are gauged in size (ranging from under ⅛" to nearly ¼") and are engineered for the particular paper material to be processed. It is these holes that form the "venting" for water removal. This venting can typically range from approximately 20 to 45 percent of the active roll surface area. The suction roll shell is driven by a drive system that rotates the shell around a stationary core called a suction box.

The suction box 20 (FIG. 2) can be thought of as conventional long rectangular box without a lid on the top and with ports on the end, bottom or sides. The end (specifically the drive end) of the box typically has a pilot bearing of which the inner raceway is a pilot bushing or bearing with a slip fit to a journal on the suction box and the outer raceway is pressed onto the rotating shell. The suction box 20 is connected with a suction source (e.g., a vacuum pump). An exemplary suction box and shell are shown in U.S. Pat. No. 6,358,370 to Huttunen, the disclosure of which is hereby incorporated herein in its entirety.

In order to take advantage of the holes in the shell, a vacuum zone 30 must be created using these ports on the inside of the suction roll shell in a zone that is directly underneath the paper pulp that is being processed. This is accomplished by the suction box 20 using a slotted holder 32 which holds a seal along the long axis of the suction box on both sides. FIG. 2 shows the slotted holders 32, and FIGS. 3 and 4 show two varieties of seals 34, 34' which are in the form of strips (hereinafter "seal strips"). In addition to these long seals there are two shorter seals (called end deckles) on the short ends (called tending and drive ends) that have some axial adjustment as needed to accommodate various sheet widths.

The seal strips 34, 34' are usually made of rubberized polymerized graphite and are held nearly in contact with the inner surface of the shell 12 during operation (see FIGS. 3 and 4). Between the seal strips 34, 34' a constant vacuum is drawn. This allows the vacuum zone 30 to be created underneath the sheet 40 as is passes over the roll 10. The seal strips 34, 34' are biased upwardly toward the suction roll shell 12 by load tubes 142, which are sealed hoses that run underneath the entire length of the seal strip 34, 34'. Pressure in the load tube 142 expands the load tube 142 (much like air in a balloon) and lifts the seal strip 34, 34' toward the inside surface of the shell 12. This effect, along with help from the system vacuum from the suction box 20 and the laminar flow of lubrication water mentioned previously, forms the seal between the edge of the seal strip 34 and the inside of the shell 12.

In actual application, in a properly functioning suction roll the seal strips 34, 34' never directly contact the inside of the suction roll shell 12. If the seal strips 34, 34' do contact the shell 12 they would wear away and would quickly lose their sealing ability. In order to eliminate or significantly reduce this wear and to provide a seal, water is applied along the length of the seal strips 34, 34' with a lubrication shower formed with water flowing through a spray nozzle 24 (see FIG. 2). This shower keeps the seal strips 34, 34' lubricated with a laminar flow of water between the seal surface and the inside surface of the shell 12.

The amount of water used for lubrication should be gauged properly so that the proper amount of lubrication is applied to keep the seal strips 34, 34' lubricated, but not so much to either become an issue for the pulp being processed or to be wasting water. In addition, process water used in a paper mill may contain chemicals and also significant particulates that may clog the lubrication shower nozzles 24 during normal operation. Since these nozzles 24 are located inside the rotating she 112 they are not visible to the paper machine operator.

SUMMARY

As a first aspect, embodiments of the invention are directed to an assembly. The assembly comprises: a seal strip with an upper surface configured to provide a seal for a suction roll; a seal strip holder, the seal strip residing in the seal strip holder and movable relative thereto; and a wear monitoring system. The wear monitoring system comprises: a magnet mounted to one of the seal strip holder and the seal strip; a magnetic field sensor mounted to the other of the seal strip holder and the seal strip; and a controller operatively connected with the magnetic field sensor. The controller is configured to receive signals from the magnetic field sensor regarding a magnetic field generated by the magnet, wherein variations in the signals denote relative movement of the seal strip and the seal strip holder, such relative movement indicating wear on the upper surface of the seal strip.

As a second aspect, embodiments of the invention are directed to an assembly comprising: a seal strip with an upper surface configured to provide a seal for a suction roll; a seal strip holder, the seal strip residing in the seal strip holder and movable relative thereto; and a wear monitoring system. The wear monitoring system comprises: an ultrasonic wave generator mounted in the seal strip and configured to transmit ultrasonic waves toward the upper surface of the seal strip; an ultrasonic wave detector mounted in the seal strip and configured to receive ultrasonic waves returning from the upper surface of the seal strip; and a controller operatively connected with the ultrasonic wave detector. The controller is configured to receive signals from the ultrasonic wave detector, wherein variations in the signals denote wear on the upper surface of the seal strip.

Each of these assemblies may be used in connection with a suction roll of a papermaking machine.

As a third aspect, embodiments of the invention are directed to an assembly comprising: a seal strip with an upper surface configured to provide a seal for a suction roll, the seal strip including a cavity therein; a seal strip holder, the seal strip residing in the seal strip holder and movable relative thereto; and a temperature monitoring system. The temperature monitoring system comprises: an infrared radiator sensor positioned in the cavity of the seal strip, the infrared radiator sensor configured to sense infrared radiation emitted into the cavity due to operation of the suction roll; and a controller operatively connected with the infrared radiation sensor, the controller configured to receive signals from the infrared radiation sensor and process the signals to indicate a temperature of the upper surface of the seal strip.

DETAILED DESCRIPTION

Figure 1:
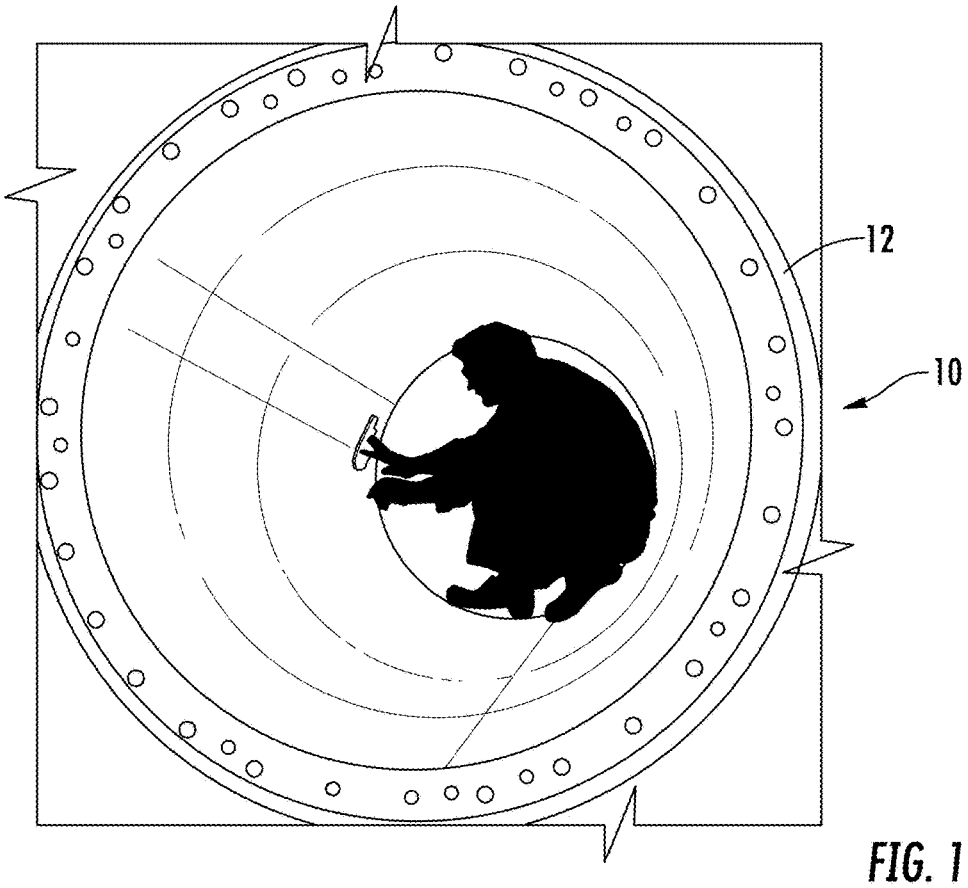
FIG. 1 is a perspective end view of a typical paper machine suction roll.
Figure 2:
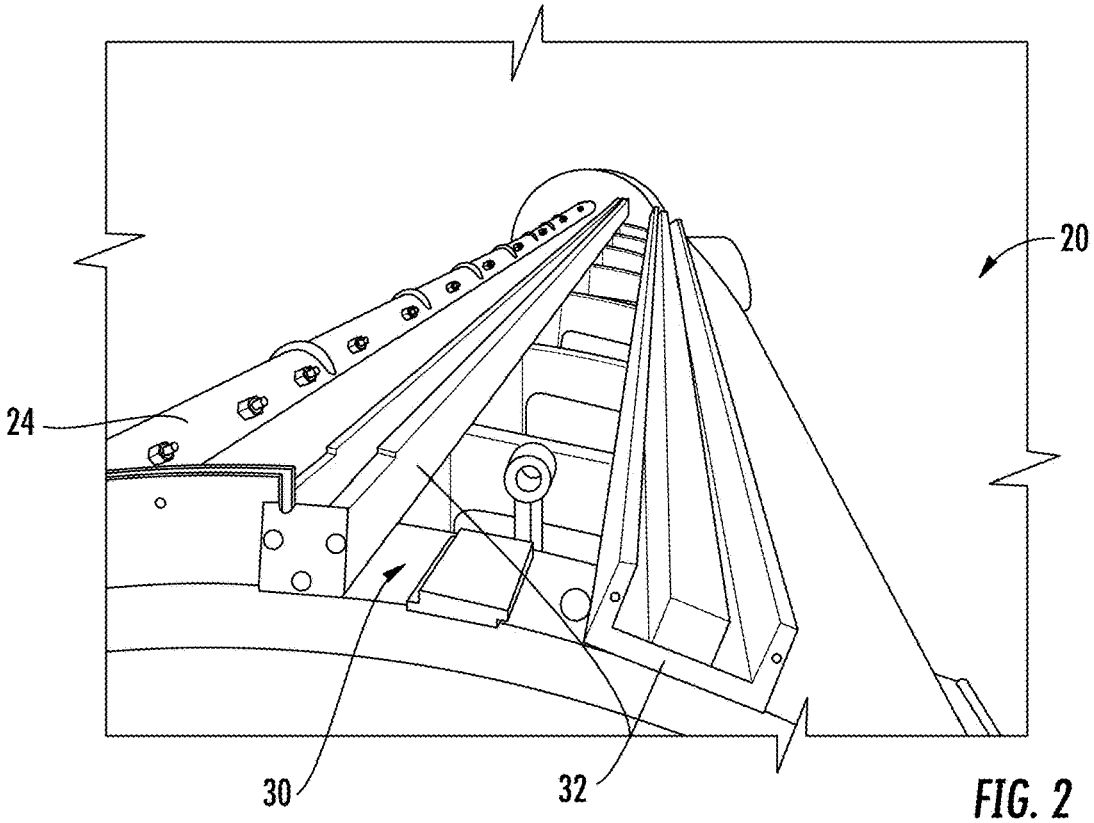
FIG. 2 is an enlarged perspective end view of the suction box area of a typical suction roll.
Figure 3:
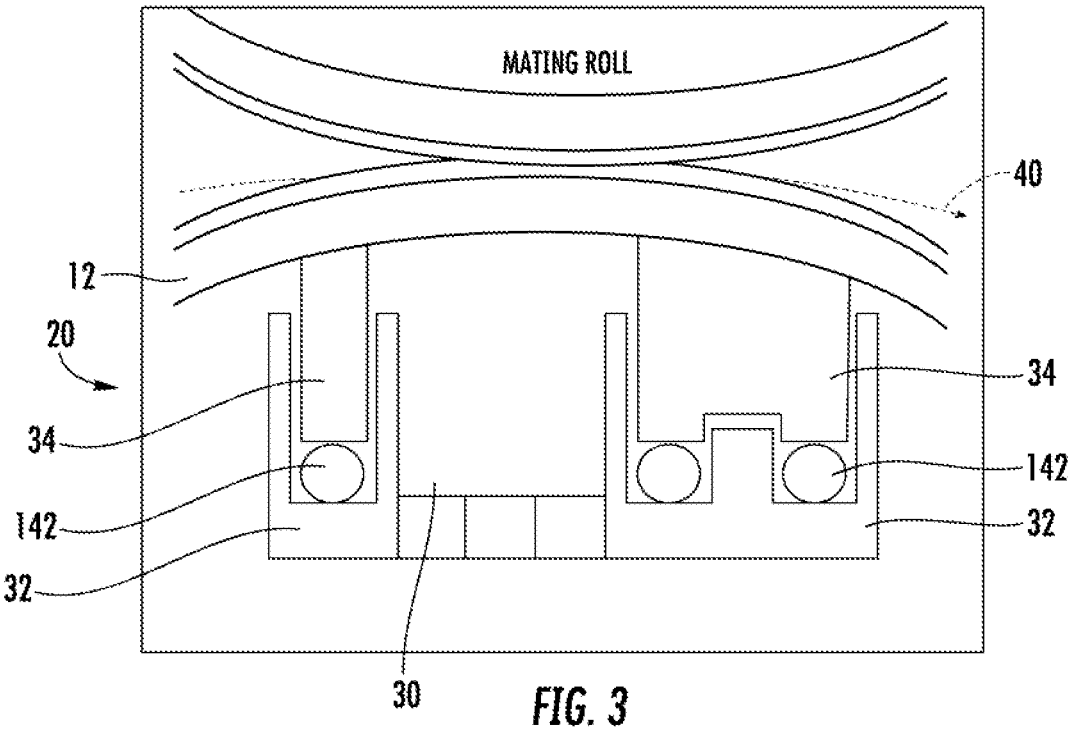
FIG. 3 is an end view of the suction box area and seal strips of a conventional suction roll.
Figure 4:
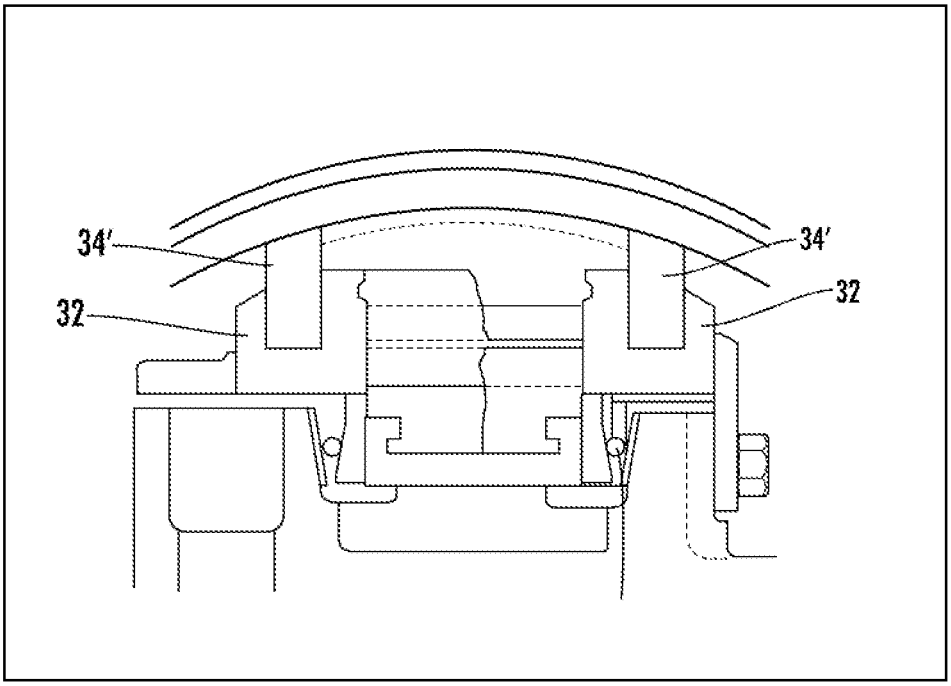
FIG. 4 is an end view of the suction box area and seal strips of another conventional suction roll.

The present invention will now be described more fully hereinafter, in which embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

Referring now to the drawings, a seal strip 100 and an accompanying wear monitoring system 120 are shown in FIGS. 5-12. With the exception of accommodations for the wear monitoring system 120 described below, the seal strip 100 is of conventional design: it is elongate and of generally constant cross-section (shown as rectangular in FIG. 5); it resides within a channel-shaped holder 102 and is supported by load tubes 104 against its lower surface 106; the load cells 104 bias the seal strip 100 upwardly (i.e., toward the shell of a suction roll) so that its upper surface 105 confronts the shell and contributes to a seal therewith; and it is formed of a polymeric material such as rubber (which may be filled with a filler, such as graphite).

Figure 5:
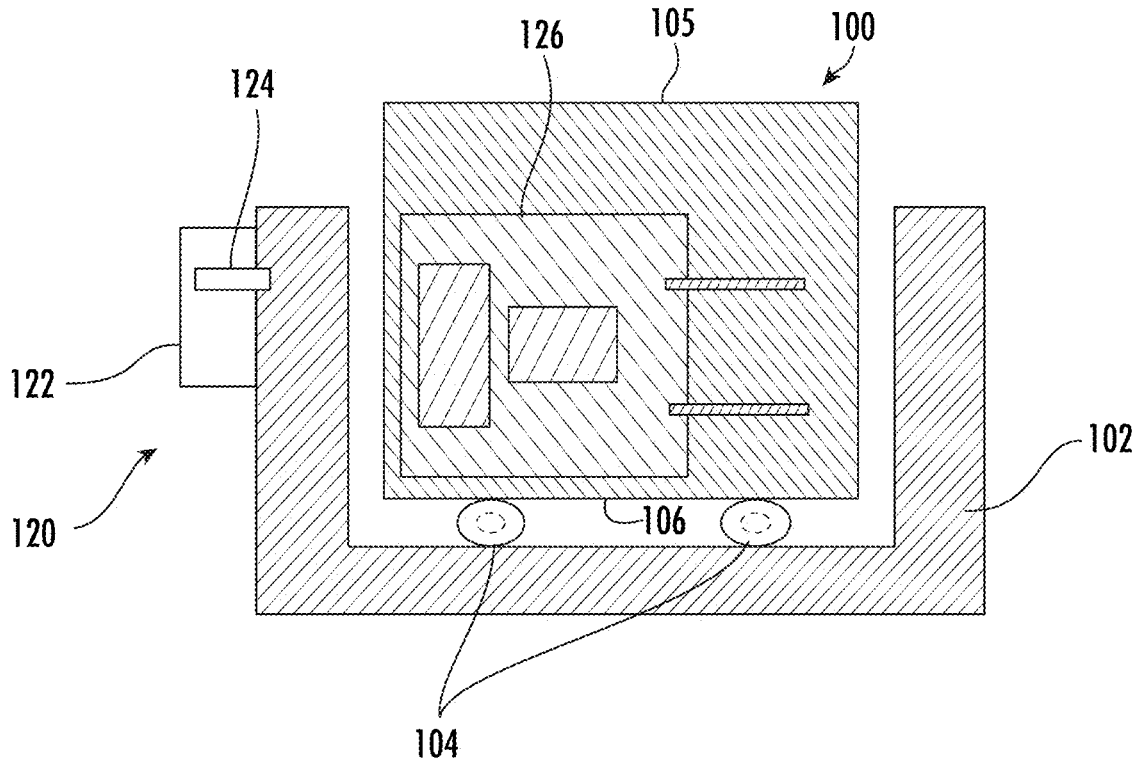
FIG. 5 is a schematic end view of a seal strip and wear monitoring system according to embodiments of the invention, with the sensor PCBs rotated for clarity.
Figure 6:
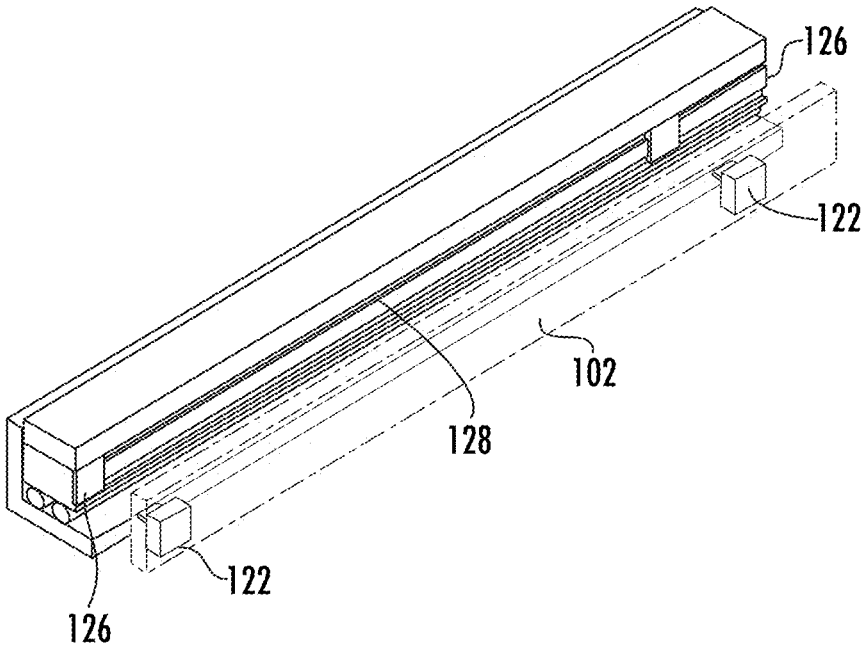
FIG. 6 is a partially exploded perspective view of the seal strip and wear monitoring system of FIG. 5.
Figure 7A:
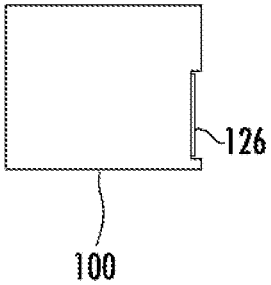
FIGS. 7A and 7B are end and fragmentary front views, respectively, of the seal strip and wear system of FIG. 5.
Figure 7B:
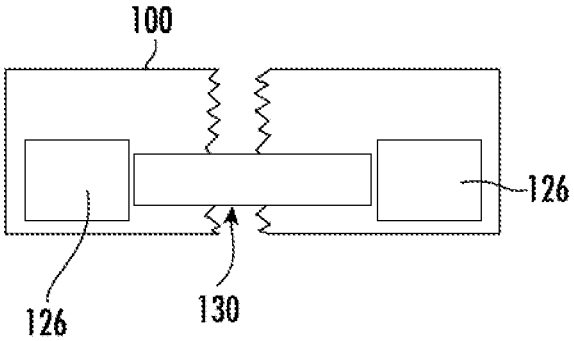

Referring still to FIG. 5 and also to FIG. 6, the wear monitoring system 120 includes two control modules 122 that are mounted to one of the side walls of the holder 102 at each end. A magnet 124 (or other magnetic field-producing component, such as an electromagnet) is mounted within each of the control modules 122. A PCB 126 is mounted adjacent each end of the seal strip 100 (see FIGS. 7A, 7B and 8). A connector PCB 130 extends between the PCBs 126. The seal strip 100 has surface recesses within which the PCBs 126, 130 are mounted.

Each of the PCBs 126 incl odes magnetic fief d sensors and/or circuitry (designated at 128 in FIG. 11) that can detect the presence and strength of a magnetic field. Exemplary magnetic field sensors include Hall Effect and magneto-resistive sensors, but other types may be used.

In basic operation, the magnetic field sensors 128 on the PCBs 126 are triggered by the magnetic field produced by the magnet 124. As the suction roll 12 rotates, it will gradually begin to wear away the adjacent (upper) surface of the seal strip 100. As wear occurs, the seal strip 100 moves away from the bottom of the holder 102 (typically upwardly) due to the biasing of the load tubes 104. As the seal strip 100 moves, the PCBs 126, and in turn the magnetic field sensors 128 mounted thereon, also move relative to the magnet 124. The relative movement of the magnetic field sensors 128 and the magnet 124 causes a change in the strength of the magnetic field detected by the magnetic field sensors 128. This change in magnetic field strength indicates movement in the seal strip 100, which in turn indicates wear on the seal strip 100.

Figure 8:
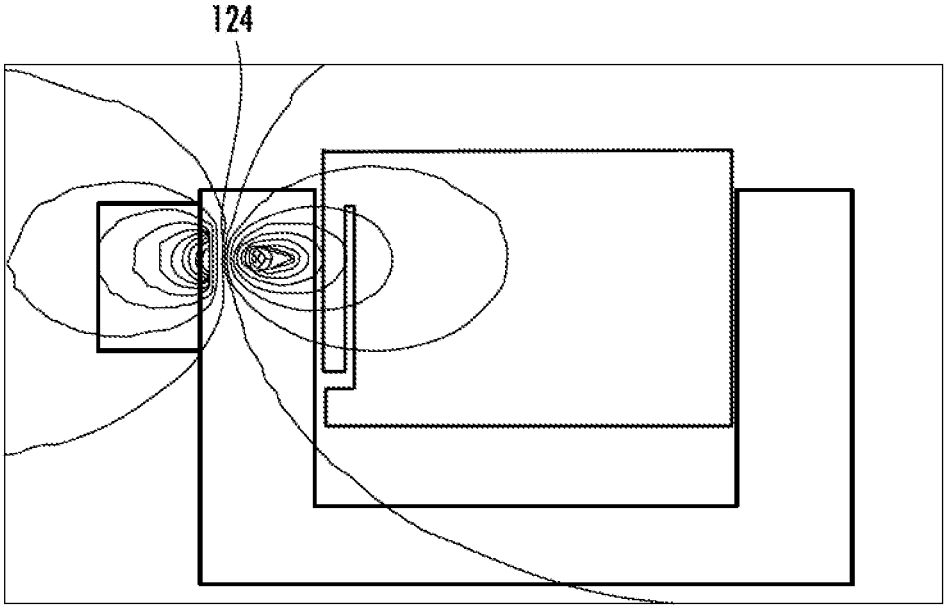
FIG. 8 is a schematic partial front view of the wear monitoring system of FIG. 5 illustrating the magnetic field created by a triangular magnet.
Figure 9:
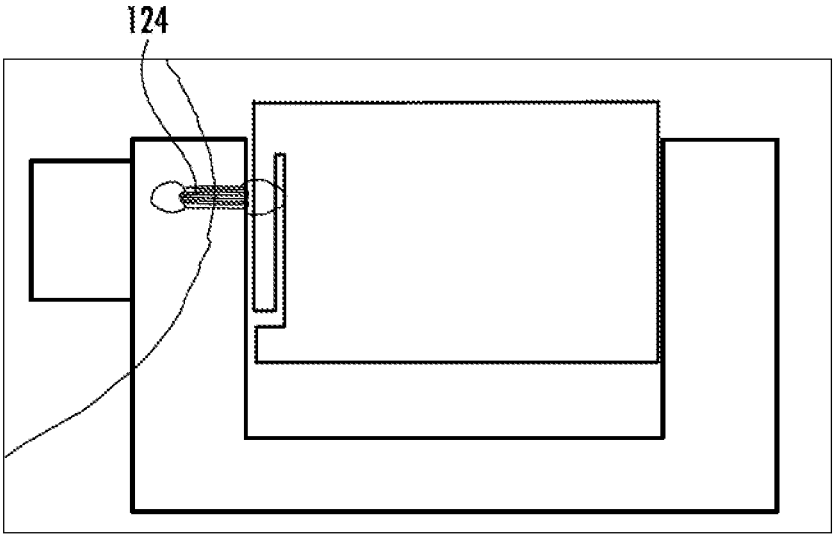
FIG. 9 is a schematic partial front view of the wear monitoring system of FIG. 5 illustrating the magnetic field created by pole piece of a magnet.
Figure 10:
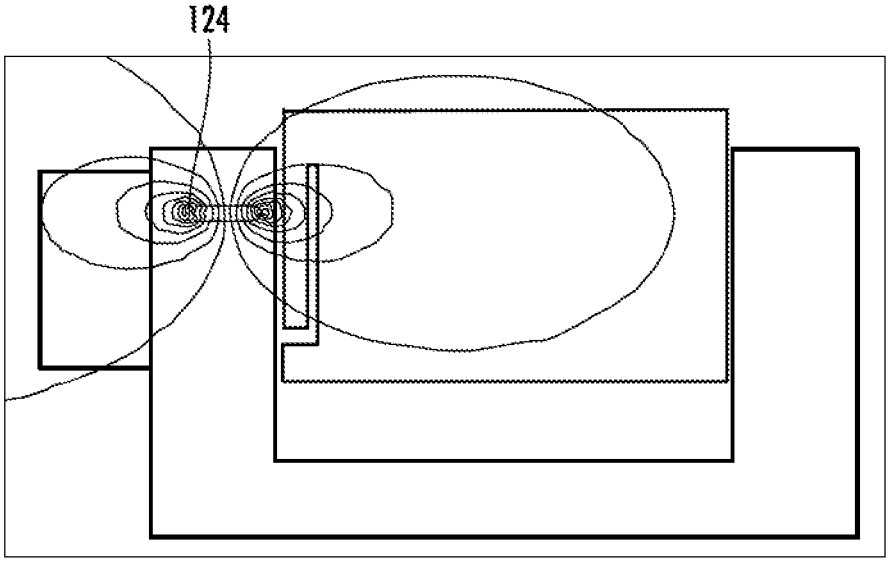
FIG. 10 is a schematic partial front view of the wear monitoring system of FIG. 5 illustrating the magnetic field created by a rectangular magnet.

As seen in FIGS. 8-10, different configurations for the magnet 124 may be employed. FIG. 10 illustrates a rectangular magnet, FIG. 9 illustrates "pole pieces" of a magnet, and FIG. 8 illustrates a triangular or "wedge-shaped" magnet. The triangular magnet 124 of FIG. 8 may have performance advantages in that the magnetic field produced thereby may vary more in strength over a given distance from the magnet 124, which can assist the magnetic field sensors 128 in detecting smaller movements of the seal strip 100 (i.e., the use of a triangular magnet may increase the granularity of sensing by the magnetic field sensors 128).

Figure 11:
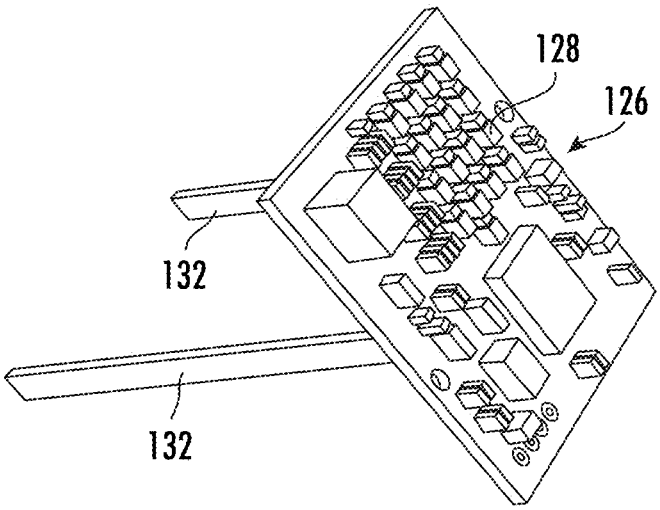
FIG. 11 is a perspective view of a sensor PCB of the wear monitoring system of FIG. 5.

In addition, two temperature sensors 132 extend into the seal strip 100 from each of the PCBs 126 (see FIG. 11). The temperature sensors 132 are configured to detect and report the temperature of the seal strip 100 itself. An increase in temperature may be interpreted as a need for increased lubrication. Monitoring the temperature while decreasing lubrication may enable the operator to determine and apply indicate the minimal lubrication needed without causing a temperature change.

Figure 12:
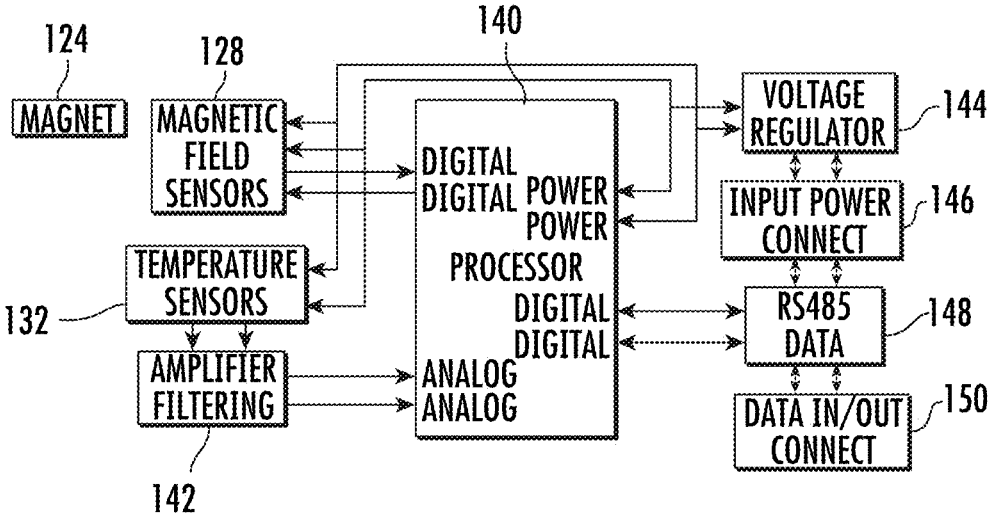
FIG. 12 is a schematic diagram illustrating the electronic components of the wear monitoring system of FIG. 5.

FIG. 12 is a schematic diagram illustrating the electronics of the wear monitoring system 120. As shown therein, the magnet 124 is in sufficient proximity to the magnetic field sensors 128 that the magnetic field of the magnet 124 can be detected. The magnetic field sensors 128 are connected with a processor 140 (also referred to herein as a "controller"), as are the temperature sensors 132. The system 120 also includes other components that facilitate data collection, transmission, and processing, including an amplifying filter 142, a voltage regulator 144, an input power connector 146, an RS-485 data bus 148, and a data "in/out" connector 150. These components are generally known and need not be described in detail herein.

Referring now to FIGS. 13-18, an alternative embodiment of a seal strip 200 and a wear monitoring system 220 is shown therein. With the exception of accommodations for the wear monitoring system 220 described below, the seal strip 200 is of conventional design: it is elongate and of generally constant cross-section (shown as rectangular in FIG. 13); it fits within a channel-shaped holder 202 and is supported by load tubes 204, which bias the seal strip 200 upwardly (i.e., toward the shell of a suction roll); and it is formed of a polymeric material.

The wear monitoring system 220 includes a piezoelectric transducer 222 that is mounted on a PCB 224. An epoxy or other insert 226 underlies the PCB 224. The transducer 222, PCB 224 and insert 226 are positioned in the bottom portion of the seal strip 200. The PCB 224 also includes other electronic components described below (see FIGS. 16 and 17).

Figure 13:
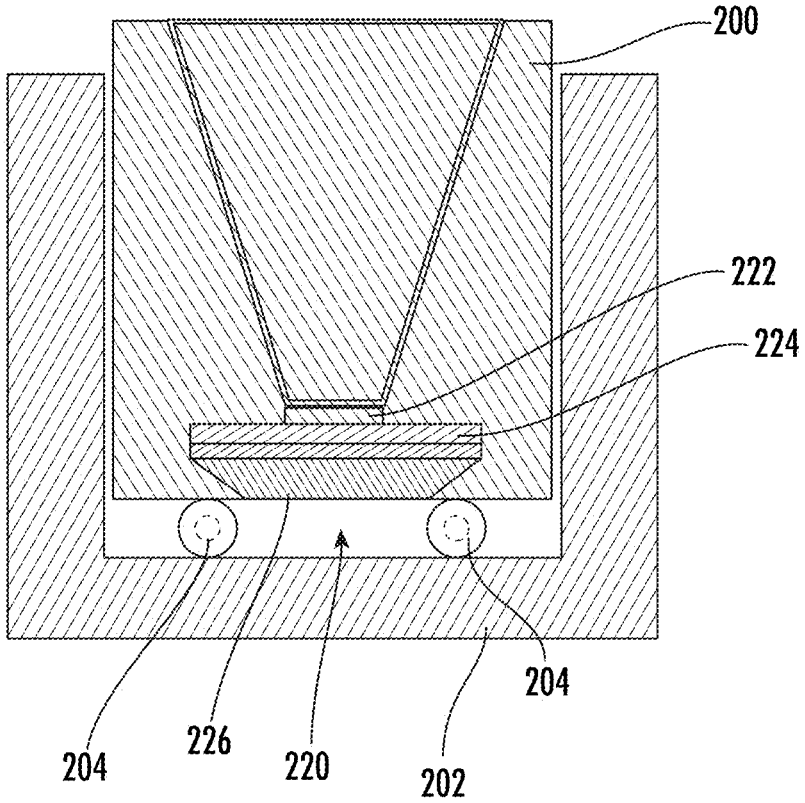
FIG. 13 is a schematic end view of a seal strip and wear monitoring system according to alternative embodiments of the invention.
Figure 14:
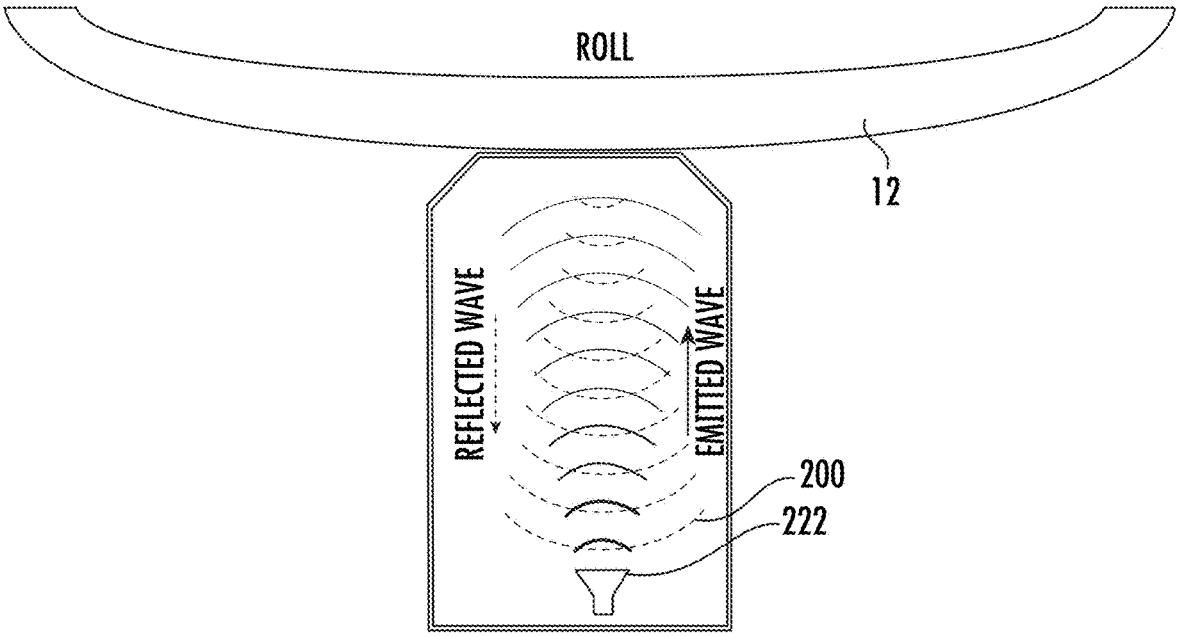
FIG. 14 is a schematic end view of the wear monitoring system of FIG. 13 showing the propagation and sensing of ultrasonic waves within the seal strip.
Figure 15:
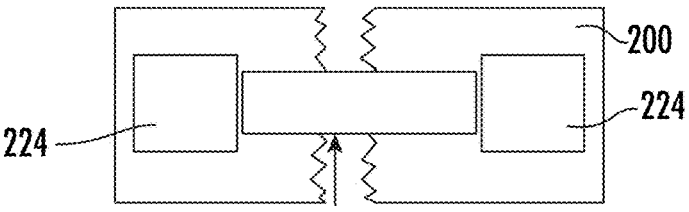
FIG. 15 is a bottom fragmentary section view of the PCBs of the wear monitoring system of FIG. 13.
Figure 16:
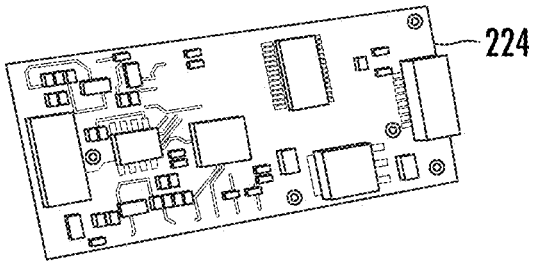
FIG. 16 is a bottom view of the ultrasonic sensing PCB of the wear monitoring system of FIG. 13.
Figure 17:
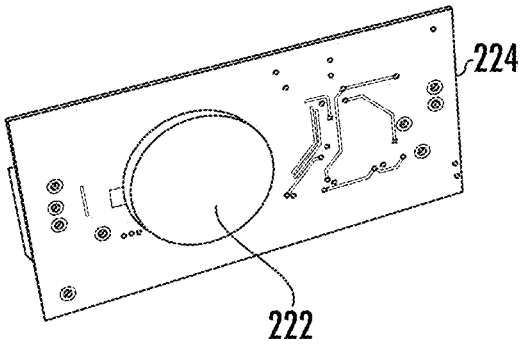
FIG. 17 is a top view of the ultrasonic sensing PCB of FIG. 15.

As illustrated in FIGS. 13 and 14, the piezoelectric transducer 222 produces ultrasonic waves that propagate through the seal strip 200 to its upper surface. When the ultrasonic waves reach a change in material composition (e.g., water or steel, as would be present beyond the upper surface of the seal strip 200), the ultrasonic waves reflect back toward the piezoelectric transducer 222. The "time of flight" (TOF) of the ultrasonic waves (i.e., total travel time from the transducer 222 to the surface and back) can be measured.

As the seal strip 200 wears, the thickness of the seal strip 200 decreases. The load tubes 204 bias the seal strip 200 upwardly toward the shell of the suction roll. Thus, with wear the distance from the piezoelectric transducer 222 to the shell (or an underlying water layer) decreases. As a result, the TOF of the ultrasonic waves also changes. Detection of the change in TOF by the piezoelectric transducer 222 is therefore an indicator of wear in the seal strip 200.

Those skilled in this art will recognize that, in some embodiments, the piezoelectric transducer may be replaced by another source of ultrasonic waves, such as a magneto-strictive transducer.

Also, although only a single piezoelectric transducer 222 is shown therein, multiple transducers 222 may be placed on the length of the seal strip 200 to provided numerous points of wear indication.

Further, in some embodiments, an insert formed of a different material may be embedded or placed into the seal strip 222 to act as the medium through which the ultrasonic waves travel. As one example, a small hole can be formed in the seal strip 200 to embed an acrylic rod or panel that extends to the upper surface of the seal strip 200. The acrylic piece can then be used to for propagation of the ultrasonic waves through. As the acrylic piece wears with the seal strip 200, it will decrease in length, and the TOE will decrease through the acrylic to indicate wear. This embodiment may enable propagation of the ultrasonic waves to be more consistent and/or the detection to be more accurate.

Further, in some embodiments, a temperature sensor may be employed that detects the temperature of the ambient air around the seal strip 200. Such detection can enable the wear monitoring system 220 to compensate for speed of sound changes with temperature through the seal strip 200.

Figure 18:
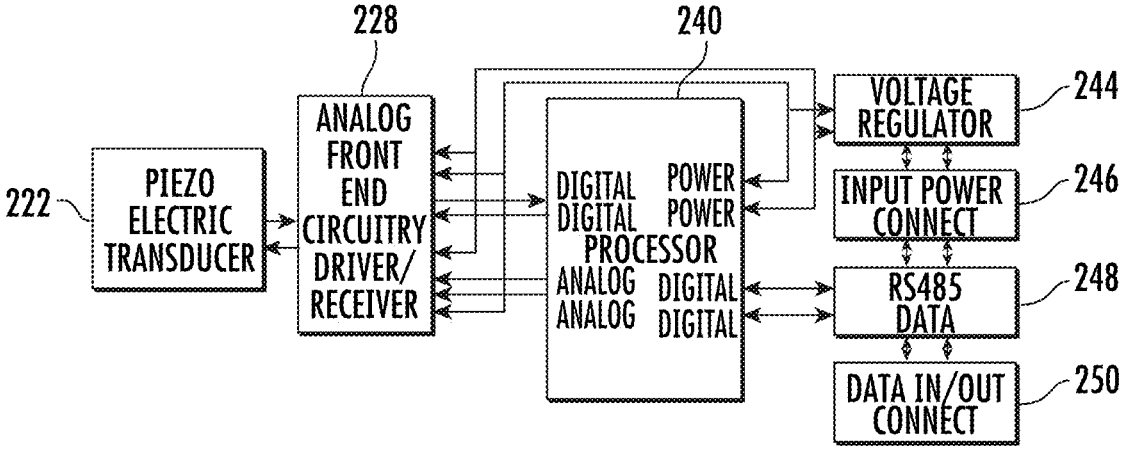
FIG. 18 is a schematic diagram illustrating the electronic components of the wear monitoring system of FIG. 13.
Figure 19:
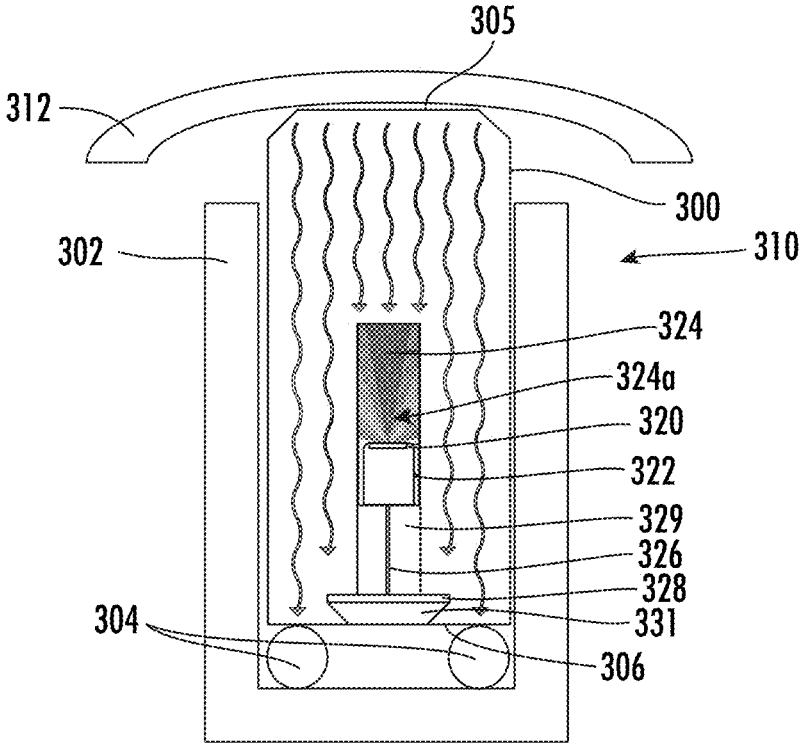
FIG. 19 is a schematic end view of a seal strip and a temperature monitoring system according to embodiments of the invention.

Referring now to FIG. 18, the electronic components of the wear monitoring system 220 are shown schematically. As shown therein, the piezoelectric transducer 222 is connected with an analog front end circuitry driver/receiver 228, which is in turn connected with a processor 240. The system 220 also includes other components that facilitate data collection, transmission, and processing, including a voltage regulator 244, an input power connector 246, an RS-485 data bus 248, and a data "in/out" connector 250. As noted above, these components are generally known and need not be described in detail herein.

Temperature monitoring systems that measure the temperature of the seal strip may also be useful. Referring now to FIGS. 19-23E, a seal strip 300 and an accompanying temperature monitoring system 320 that comprise an assembly 310 are shown in FIGS. 5-8. With the exception of accommodations for the temperature monitoring system 320 described below, the seal strip 300 is of conventional design: it is elongate and of generally constant cross-section (shown as rectangular in FIG. 19); it resides within a channel-shaped holder 302 and is supported by load tubes 304 against its lower surface 306; the load cells 304 bias the seal strip 300 upwardly (i.e., toward the shell 312 of a suction roll) so that its upper surface 305 confronts the shell and contributes to a seal therewith; and it is formed of a polymeric material such as rubber (which may be filled with a filler, such as graphite).

The temperature monitoring system 320 includes an infrared thermopile array sensor 322 that is located within a cavity 324 in the seal strip 300 that extends axially for much of the length of the seal strip 300. The infrared thermopile array sensor 322 is a single sensor that can, from a distance, sense infrared thermal radiation being emitted by solid matter. Thermopiles typically include many thermocouples mounted on a silicon chip. The thermopiles generate a small electric voltage when exposed to infrared (IR) radiation or heat. Generally speaking, the higher the temperature of the object being measured, the more IR energy is emitted. The thermopile sensing elements absorb the energy and produce an output signal. A reference sensor is typically designed into the package as a reference for compensation. The configuration of the sensor 322 allows it to sense infrared radiation across a wide field of view (often limited or focused by a lens), which is then processed to create a temperature grid representative of the sensed temperature. An exemplary infrared thermopile array sensor is Model No. MLX90641, available from Melexis (Tessenderlo, Belgium).

The sensor 322 is connected via cables 326 to a series of printed circuit boards (PCBs) 328 that are also located within the cavity 324. The PCBs 328 are interconnected with each other by cables 334 (see FIG. 21). In some embodiments, the cables 326 are encased in a potting compound 329 or the like for protection; similarly, in some embodiments the space in the cavity 324 below the PCBs 328 may also be filled with a potting compound 331 or other protective material. The space 324*a* within the cavity 324 that is above the above the sensor 322 typically remains empty.

Figure 20A:
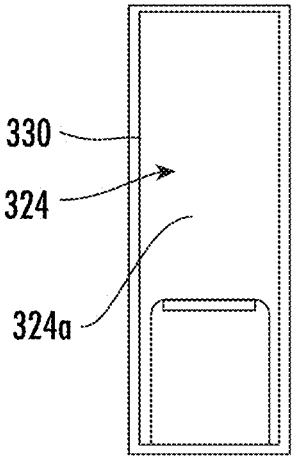
FIG. 20A is a partial end view of the infrared thermopile array sensor of the temperature monitoring system of FIG. 19 shown with a shell that lines the cavity of the seal strip.
Figure 20B:
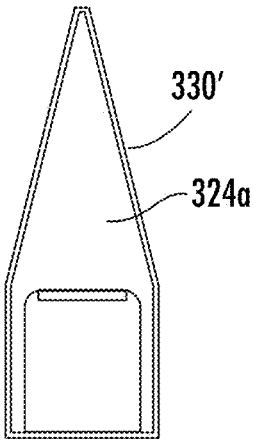
FIG. 20B is a partial end view of the infrared thermopile array sensor of the temperature monitoring system of FIG. 19 shown with an alternative embodiment of a shell that lines the cavity of the seal strip.
Figure 21:
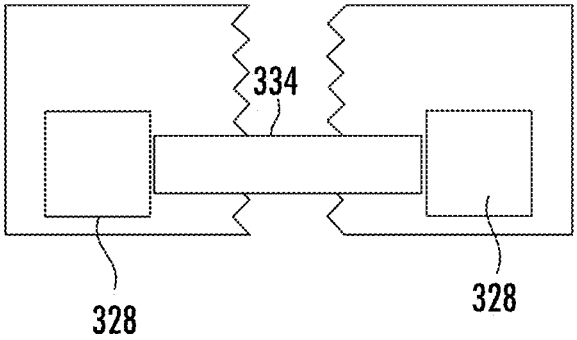
FIG. 21 is a bottom fragmentary section view of the PCBs of the temperature monitoring system of FIG. 19.

As shown in FIGS. 20A and 20B, in some embodiments a shell or housing 330 may be included to line the cavity 324, thereby protecting the empty space above the sensor 322 and/or providing reinforcement for the seal strip 300. The shell 330 may take any number of configurations; as examples, in FIG. 20A the shell 330 is generally rectangular in profile; in FIG. 20B, a shell 330' is shown having a profile of a tall, slender pentagon. Other profile shapes (e.g., a triangle, a semi-hexagon or semi-octagon, an archway, etc.) may also be employed.

The material comprising the shell 330 should be thermally transmissive, so as to have minimal impact on the temperature of the seal strip 300 being sensed by the sensor 322. The she Is 330, 330' may be formed of a number of suitable materials. Exemplary materials for the shells 330, 330' include, thermoset resins (e.g., epoxy, polyurethane, polyurea, polyurethane-urea, vinyl ester, polyimide, bismaleimide, phenol formaldehyde, silicone, diallyl-phthalate, melamine, acrylate, cyanate ester, furan, and benzoxazine), rubbers (e.g., natural rubber, chloroprene rubber, styrene butadiene rubber, butadiene acrylonitrile copolymer rubber, hydrogenated butadiene acrylonitrile rubber, acrylonitrile-butadiene-isoprene terpolymer rubber, carboxylated nitrile terpolymer, silicone rubber, chlorosulfonated polyethylene rubber, ethylene proplylene diene rubber, and fluoroelastomer), and thermoplastic resins (e.g., thermoplastic polyurethane, polyethylene, polypropylene, polyester, acrylic, polystyrene, polyacrylonitrile, maleimide resin, polyamide, and liquid crystal polymers). The material may be unfilled, or may include one or more fillers, such as carbides (e.g., silicon carbide, boron carbide, aluminum carbide, titanium carbide, and tungsten carbide), nitrides (e.g., silicon nitride, boron nitride, aluminum nitride, gallium nitride, chromium nitride, tungsten nitride, magnesium nitride, molybdenum nitride, and lithium nitride), carbon-based compounds (e.g., carbon black, carbon fiber, graphite, graphene, diamond, fullerenes, carbon nanotubes and carbon nanofiber), metals (e.g., aluminum, nickel, tin, iron, copper and silver), and metal oxides (e.g., beryllium oxide, aluminum oxide, magnesium oxide, silicon oxide and barium titanate). Any fillers may have high aspect ratio to increase the modulus of the composite. The fillers may also have high emissivity. Additional non-conductive fillers may also be added to modify the mechanical properties of the composite, and additional additives, solvents, and fillers may be added to modify the rheological properties of the composite before curing or cooling.

Figure 23A:
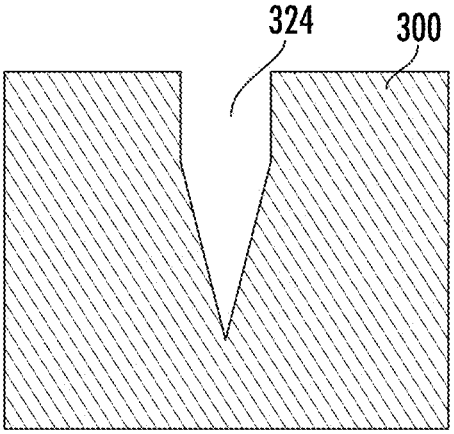
FIGS. 23A-23E are schematic illustrations of steps performed to form the shell and position the sensor of the system of FIG. 19.
Figure 23B:
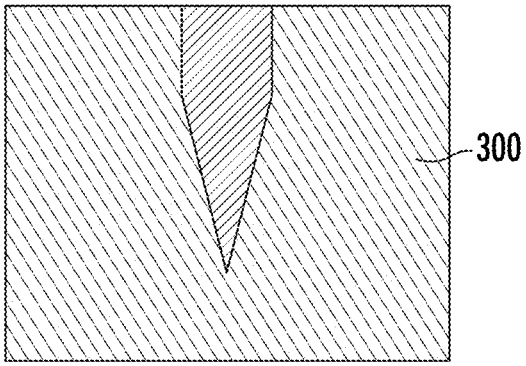
Figure 23C:
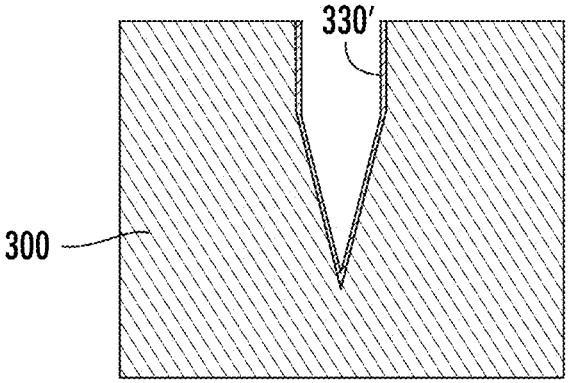
Figure 23D:
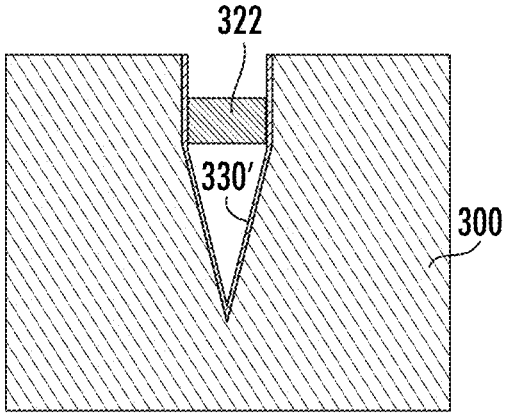
Figure 23E:
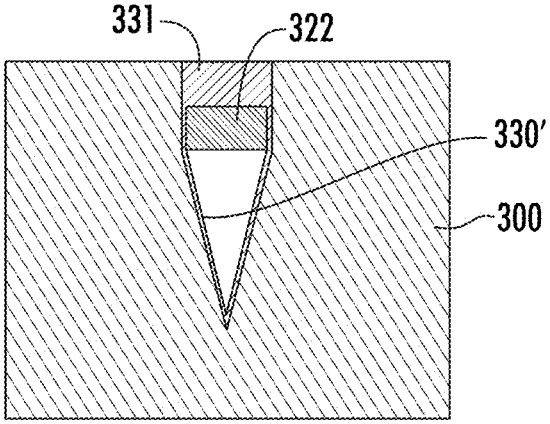

In some embodiments, the shell 330, 330' may be preformed and inserted into the cavity 324. In other embodiments, the shell 330, 330' may be formed in the cavity. One manufacturing technique is illustrated in FIGS. 23A-23E. First, the cavity 324 is formed (e.g., via milling) in the seal strip 300 (FIG. 23A). Most or all of the cavity 324 is filled with the material from which the shell 330' is to be formed (FIG. 23B). Most of the material of the shell 330' is then removed (e.g., via milling), such that the material that remains forms the shell 330' (FIG. 23C). The sensor 322 and its accompanying electronics are positioned in the shell 330' (FIG. 23D). Finally, the space between the sensor 322 and the outer surface of the seal strip 300 is filled with a potting material 331, which may be the same as or differ from that of the shell 330' (FIG. 23E). This technique can ensure that the shell 330' fits tightly within the seal strip 300, and can also eliminate the need for an additional layer of adhesive material that might otherwise be necessary to secure a pre-made shell within the cavity.

In operation of the papermaking machine, rotation of the suction roll 10 relative to the seal strip 300 generates heat. That heat spreads downwardly toward the base of the seal strip 300, decreasing in intensity as the distance increases. As a result of the heat, infrared radiation is emitted from the material of the seal strip 300 surrounding the cavity 324 (or from the shell 330 that lines the cavity 324), with the material nearer the contact point of the seal strip 300 generating a greater amount of infrared radiation. The sensor 322 senses the infrared radiation being emitted at multiple axial locations along the inside surface of the cavity 324. From this information, an array of temperatures is determined for the seal strip 300 at different points along the surface of the seal strip 300, which can be used to assess potential wear of the surface of the seal strip 300.

Figure 22:
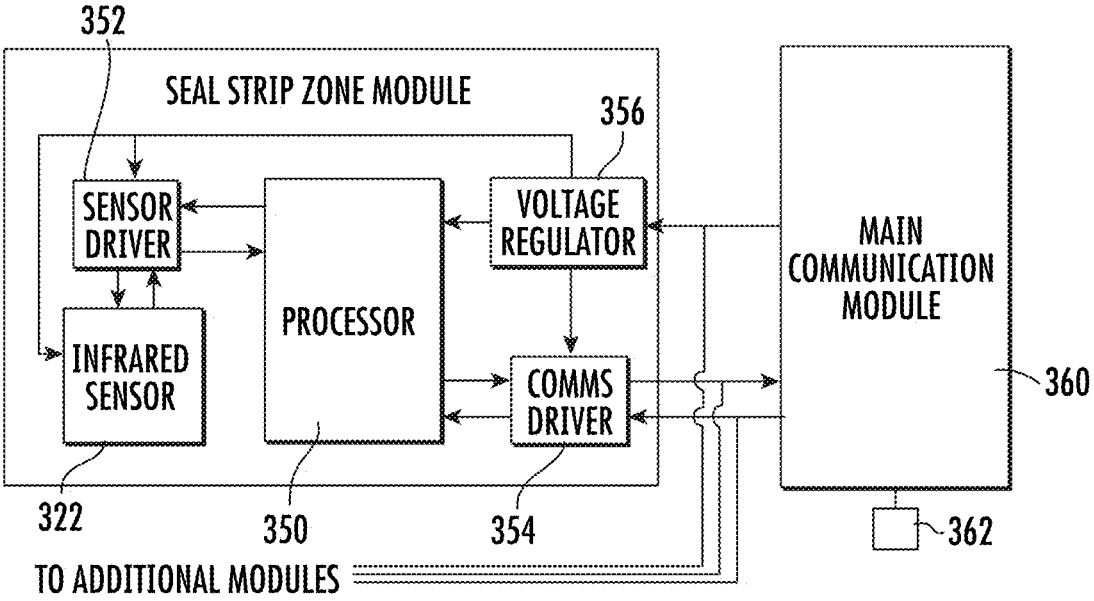
FIG. 22 is a schematic diagram illustrating the electronic components of the wear monitoring system of FIG. 19.

Electronic components of the temperature monitoring system 320 (some of which may be mounted on the PCBs 328) are shown in FIG. 22. These may include a processor 350 and driver circuitry 352, which are used to interface with the sensor 322. A communications driver 354 acts as a bridge between the processor 350 and a main communication module 360, which is mounted remotely from the seal strip 300. A voltage regulation section 356 allows for the appropriate voltages to be supplied to the system. The main communication module 360 allows for wireless communication between the system and an operator display 362).

Those skilled in this art will appreciate that the temperature monitoring system 320 may be accompanied by one or more other systems, such as the wear monitoring systems 120, 220 discussed above. Wear information may be combined with the infrared radiation sensed by the sensor 322 to arrive at an overall wear/temperature profile for the seal strip 300. It will also be understood that, in some instances, an ultrasonic transducer used for such sensing and the infrared sensor 322 may both be connected with the same PCB 328, which would include components for receiving and processing both ultrasonic and infrared signals and for transmitting processed signals to the main communications module 360 and/or the operator display 362).

Those skilled in this art will recognize that, in some embodiments, the infrared thermopile array sensor 322 may be replaced by another variety of infrared radiation sensor within the cavity 324 that can sense, then provide, information on the temperature of the seal strip 300.

Also, although only a single infrared thermopile array sensor 322 is shown therein, multiple sensors 322 may be placed on the length of the seal strip 200 to provide IR readings at numerous locations.

Further, in some embodiments, temperature and/or humidity sensors may be employed that sense the temperature and/or humidity of the ambient air around the seal strip 300. Such sensing can enable the temperature monitoring system 320 to compensate for any changes in infrared radiation through the seal strip 300 due to environmental factors.

Regarding the electronics and microcontrollers discussed above, embodiments of the present inventive concepts may be embodied in hardware and/or in software (including firmware, resident software, micro-code, etc.). Furthermore, exemplary embodiments of the present inventive concepts may take the form of a computer program product comprising a non-transitory computer-usable or computer-readable storage medium having computer-usable or computer-readable program code embodied in the medium for use by or in connection with an instruction execution system. In the context of this document, a computer-usable or computer-readable medium may be any medium that can contain, store, communicate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, or device. More specific examples (a nonexhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Exemplary embodiments of the present inventive concepts are described herein with reference to flowchart and/or block diagram illustrations. It will be understood that each block of the flowchart and/or block diagram illustrations, and combinations of blocks in the flowchart and/or block diagram illustrations, may be implemented by computer program instructions and/or hardware operations. These computer program instructions may be provided to a processor of a general purpose computer, a special purpose computer, or other programmable data processing apparatus to produce a machine, such that the instructions, which execute via the processor of the computer or other programmable data processing apparatus, create means and/or circuits for implementing the functions specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart and/or block diagram block or blocks.

In some embodiments the controller may be connected to or associated with (either hard-wired or wirelessly) a display device (e.g., a monitor, tablet, smart phone, laptop, etc.) that can produce one or more visual displays regarding the temperature, wear and/or lubrication parameters of the system. Also, in some embodiments, the controller is configured to make recommendations regarding the amount of lubrication based on the "wear" signals and/or the temperature signals from the temperature sensors within the seal strips. The controller may also be configured to provide an alert or alarm (visual, auditory, or otherwise) to signal that a certain threshold parameter has been reached (e.g., a threshold temperature or wear level) so that the parameter of interest can be addressed.

In addition, in some embodiments, a temperature sensor for the internal bearing may be installed inside the lubrication line for the internal bearing. This temperature sensor may detect the temperature of the lubricant and can indicate a change in bearing temperature. Further, in some embodiments a vibration sensor may be installed in proximity to the internal bearing to detect vibration in the internal bearing. Other possibilities are discussed in U.S. Pat. No. 10,822,744 to Reaves et al., the disclosure of which is hereby incorporated herein in its entirety.

It should also be noted that the wear monitoring systems 120, 220 and the temperature monitoring system 320 may employ different components for performing different functions. For example, the load tubes 104, 204, 304 may be replaced with other components (e.g., springs, resilient pads, or the like) that bias the seal strips 100, 200, 300 toward the shell of the suction roll. The seal strip holders 102, 202, 302 may take different configurations.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. An assembly, comprising:

a seal strip with an upper surface configured to provide a seal for a suction roll, the seal strip including a cavity therein;

a seal strip holder, the seal strip residing in the seal strip holder and movable relative thereto; and a temperature monitoring system comprising:

an infrared thermopile array sensor positioned in the cavity of the seal strip such that empty space exists within the cavity above the infrared thermopile array sensor, the infrared thermopile array sensor comprises a plurality of thermopiles, each of the thermopiles configured to generate a small electric voltage when exposed to infrared radiation emitted into the cavity due to operation of the suction roll; and a controller operatively connected with the infrared thermopile array sensor, the controller configured to receive signals from the infrared thermopile array sensor and process the signals to provide a temperature grid representative of the temperature of the upper surface of the seal strip.

2. The assembly defined in claim 1, further comprising a shell that lines the cavity.

3. The assembly defined in claim 2, wherein the shell is formed of polymeric material.

4. The assembly defined in claim 1, wherein the cavity has an open lower end.

5. The assembly defined in claim 1, wherein the open end of the cavity is filled with a potting compound.

6. The assembly defined in claim 1, wherein the controller includes a printed circuit board, and wherein the printed circuit board is positioned in the cavity.

7. The assembly of claim 1 in combination with a suction roll, wherein the suction roll comprises:

a cylindrical shell having an internal lumen and a plurality of through holes;

a suction box positioned in the lumen of the shell; and a suction source operatively connected with the suction box;

wherein the seal strip and seal strip holder are mounted in the suction box, such that the upper surface of the seal strip confronts an inner surface of the shell.

* * * * *